United States Patent [19]

D'Ambrosio

[11] Patent Number: 4,708,343

[45] Date of Patent: Nov. 24, 1987

[54] APPARATUS FOR BASEBALL BATTING PRACTICE

[76] Inventor: Louis J. D'Ambrosio, 10 Willaway, Massapequa, N.Y. 11758

[21] Appl. No.: 793,891

[22] Filed: Nov. 1, 1985

[51] Int. Cl.[4] ..... A63B 71/02

[52] U.S. Cl. ..... 273/26 R

[58] Field of Search ..... 273/26 R, 26 A, 29 A, 273/186 A, 186 B, 186 R, 186 C, 183 R, 181 H, 183 E

[56] References Cited

U.S. PATENT DOCUMENTS

| | | | |
|---|---|---|---|
| 3,117,451 | 1/1964 | Ray et al. | 273/26 R |
| 3,802,709 | 4/1974 | Elkins | 273/186 A |
| 4,251,077 | 2/1981 | Pelz et al. | 273/186 A |
| 4,306,722 | 12/1981 | Rusnak | 273/186 A |
| 4,341,384 | 7/1982 | Thackrey | 273/186 A |
| 4,461,477 | 7/1984 | Stewart | 273/186 C |
| 4,577,863 | 3/1986 | Tatsumi | 273/186 A |

*Primary Examiner*—Richard C. Pinkham

*Assistant Examiner*—T. Brown

*Attorney, Agent, or Firm*—Ostrolenk, Faber, Gerb & Soffen

[57] ABSTRACT

A baseball practice apparatus comprised of a vertically extending panel having a plurality of selectively operable lights which generate focused light beams directed forward from the panel. A player swings a bat having a light reflecting surface which will intercept and cause the light beams to be reflected back towards the panel. On the panel there is an array of spaced light sensors. One of the light sensors detects the reflected light, and a visual indication is provided of the simulated result of the swing, for example, a "line drive" or a "fly ball". A foregoing visual display is provided in response to which light, or lights, were illuminated to simulate a pitched ball and which sensor sensed reflected light from the bat. A "curve", a "sinker" or other pitch is simulated, by actuating selected lights in a predetermined sequence.

19 Claims, 10 Drawing Figures

LINE DRIVE

FLY BALL

GROUND BALL

HOME RUN

SINGLE

FIG. 8
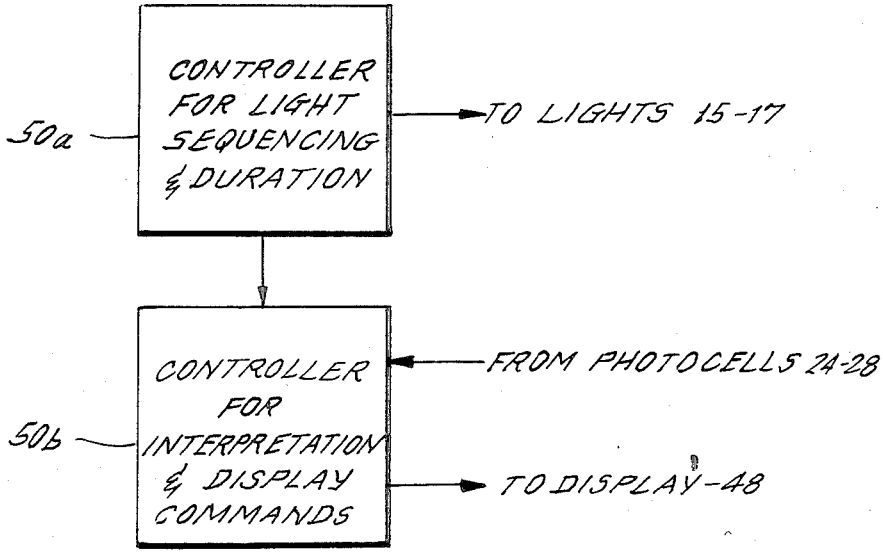
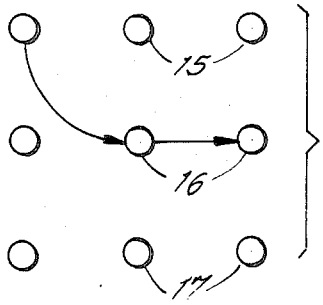
FIG. 9
CURVE BALL
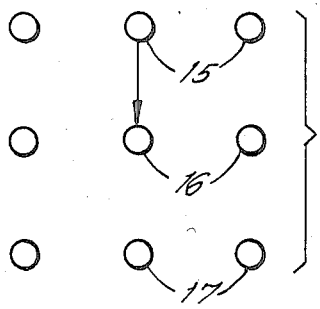
FIG. 10
SINKER BALL

APPARATUS FOR BASEBALL BATTING PRACTICE

BACKGROUND OF THE INVENTION

The present invention relates to an apparatus with which a baseball batter may practice swinging of a bat. The invention more particularly relates to a baseball batting practice apparatus in which no moving mechanical parts, such as a baseball, are required, except for a bat which is swung by the user.

To maintain proficiency in the game of baseball requires a batter to practice hitting pitched balls that are at varying heights and have different trajectories ("curve", "slider", "sinker", etc.). The batter's reaction time and swing result in different types of "hits", such as a "straight line drive", a "rising line drive" or a "fly ball".

It would be desirable to provide a baseball batting practice apparatus with which an individual may practice batting without the need for a large area in which to hit a ball, or another person to pitch the ball. Further, it would be desirable to eliminate the need for an actual ball to be pitched by mechanical means, so that precautions need not be taken to prevent the ball from striking objects unintentionally.

By providing immediate visual or audio feedback to the player, he can adjust his swings to correct for deficiencies. The baseball playing apparatus additionally should use a minimum number of parts to reduce complexity and cost.

SUMMARY OF THE INVENTION

Accordingly, it is an object of the invention to provide novel baseball batting practice apparatus that does not require a mechanically pitched ball.

It is a further object of the invention to provide baseball batting practice apparatus of this type in which the simulated results of swinging a bat are immediately indicated to the batter in visual or audio form.

Yet another object is to provide baseball batting practice apparatus of this type in which a minimum number of parts are used to reduce complexity and cost.

The foregoing objects of the invention are realized in a baseball batting practice apparatus including a plurality of spaced, light-emitting devices, such as incandescent lights that are optically focussed into narrow beams. The light-emitting devices simulate a pitched ball by directing one or more respective outgoing beams of light forward to a batting zone. Hence, no actual pitched ball is required. Pickups or sensing means are disposed in proximity to the light-emitting devices to receive reflected light from a light-reflecting portion of a bat swung through the batting zone and intercepting one of the outgoing beams of light. A control means is used to selectively actuate at least one of the light-emitting devices at a time, and another control means is used to indicate which of the pickup means has received the reflected light.

In accordance with a further feature of the invention, the light-emitting devices are actuated for predetermined intervals, or in predetermined sequences, to simulate different types of pitched balls, such as pitched balls of various speeds, or non-straight pitched balls (curves, sinkers, etc.).

To reduced the number of parts required in the apparatus, the pickup means comprises a plurality of associated pairs of light sensors and wide-angle lenses. The wide-angle lenses receive reflected light over a wide angle and direct the received light to the associated light sensor. Accordingly, the overall number of light sensors may be kept to a minimum.

Other objects and features of the invention will be explained with reference to the accompanying drawings.

BRIEF DESCRIPTION OF THE DRAWINGS

FIG. 8 is a block diagram of a controller that may be incorporated with the baseball batting practice apparatus of FIG. 1.

FIGS. 9 and 10 are schematics illustrating respective sequences of activation of lights of the apparatus of FIG. 1 to simulate different types of pitched balls.

DETAILED DESCRIPTION OF THE PREFERRED EMBODIMENTS

Figure 1:
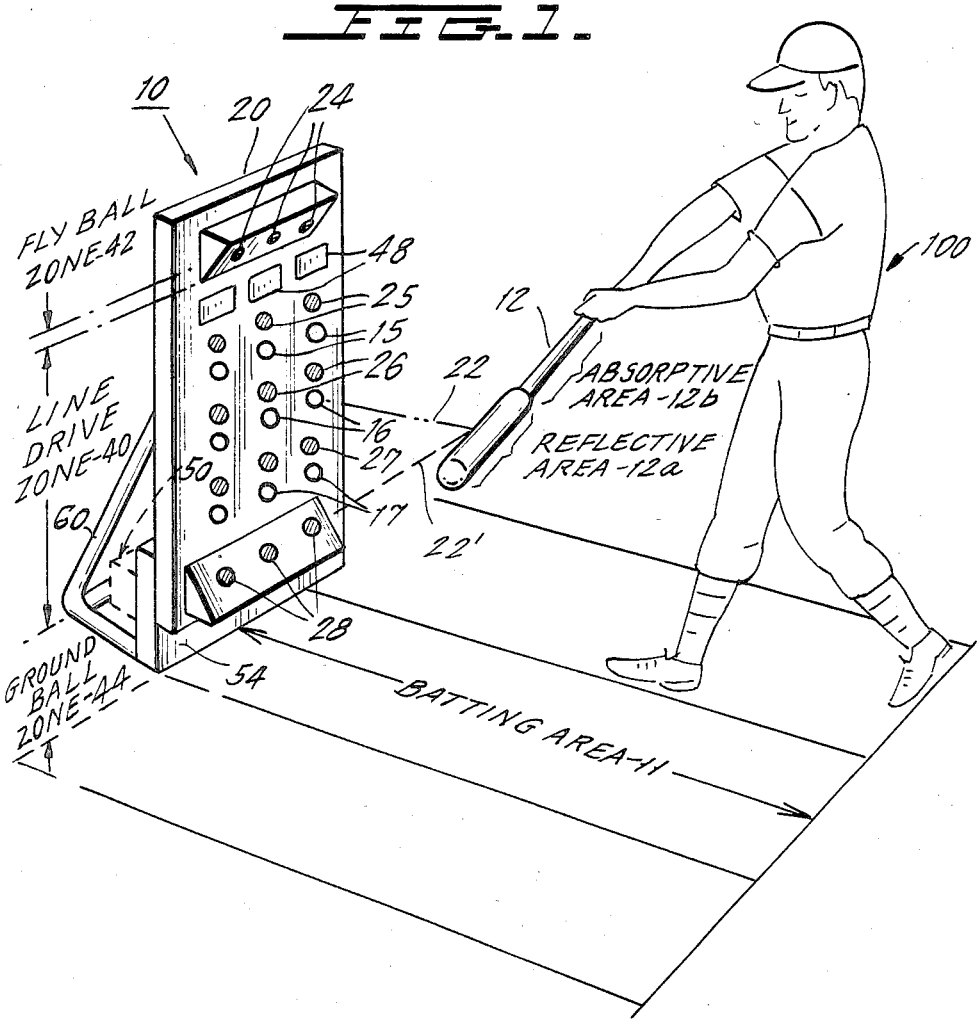
FIG. 1 is a perspective view of baseball practice apparatus constructed in accordance with the present invention.

FIG. 1 illustrates an apparatus 10 with which individual player or user 100 swinging baseball bat 12 may engage in batting practice. No baseball or other mechanical moving parts are required to operate apparatus 10, except for baseball bat 12. Rather, apparatus 10 relies upon the use of optics in cooperation with baseball bat 12, which is swung by player 100 in a batting area 11, to simulate baseball batting practice.

Apparatus 10 includes a plurality of focused light sources 15, 16, and 17, which are mounted on upright panel 20. These lights 15, 16 and 17 are each capable of directing a light beam such as beam 22 into batting area 11. The wide portion of the bat 12, which is the batting surface, comprises a reflective area 12*a*. The thinner region of the bat 12, which includes the gripping area, comprises a light absorptive area 12*b*.

To sense light beam 22', which is reflected from bat 12, apparatus 10 is provided with a plurality of light sensors 24, 25, 26, 27 and 28, schematically shown with cross hatching to distinguish them from the light sources 14, 15 and 17.

Figure 2:
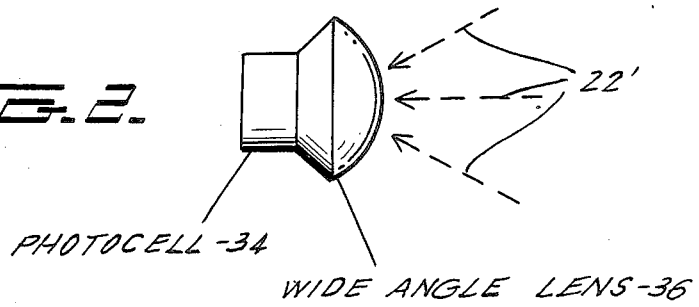
FIG. 2 is a schematic view of a light sensor capable of detecting light over a wide angle.

An exemplary light sensor 24, shown in FIG. 2, comprises photocell 34 or other light detection means, and a wide angle lens 36 that directs reflected light 22' to photocell 34 from directions at, above or below the photocell 34. The optical angle of lens 36 is chosen such that reflected light 22' from bat 12 activates only one of the light sensors 24–28. Thus, any overlap in light reception amongst several of the light sensors 24–28 is minimized so that only one of the sensors is triggered at a any given time. Alternatively, comparative light level detectors may be used in association with each light sensor 24–28 so that only a single light sensor 24–28 becomes activated at any given time.

Apparatus 10 of FIG. 1 is preferably divided into three zones. The zone in the vertical center of panel 20 is a line drive zone 40, while the zones above and below zone 40 constitute "fly ball" and "ground ball" zones 42 and 44, respectively. Thus, light sensors 25, 26 and 27 in line drive zone 40, when activated by reflected light beam 22', are indicative of a line drive by the batter. Similarly, light sensors 24 are indicative of a fly ball when activated, and light sensors 28 indicate a ground ball when activated.

Figure 3:
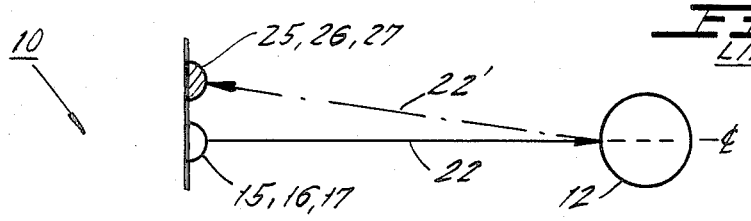
FIGS. 3–7 are schematics showing various types of simulated "hits" of a simulated pitched ball.

Light sensors 24–28 operate in conjunction with light emitters 15, 16 and 17 as now explained with particular reference to FIGS. 3–6. More particularly, FIG. 3 illustrates a line drive in that light beam 22 emitted from light source 15, 16 or 17 is reflected from approximately the vertical center of bat 12 so that reflected beam 22' then impinges upon the associated light sensor 25, 26, or 27.

Figure 4:
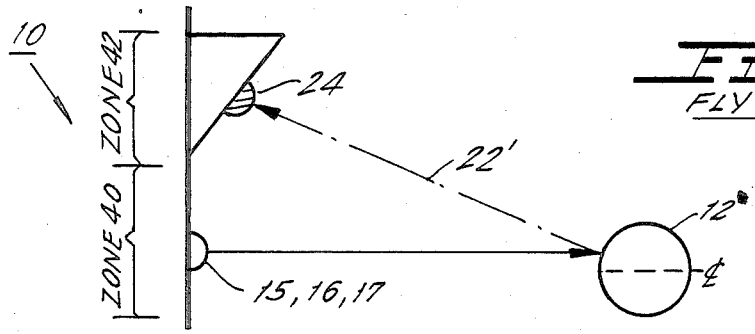

An indication of a fly ball is provided as illustrated in FIG. 4, wherein light beam 22 emitted from light source 15, 16 or 17 reflects from the upper portion of the bat 12. This reflected beam 22' is directed towards a light sensor 24 in fly ball zone 42 (FIG. 1). Light sensor 24 is inclined forward and upward from the line drive zone 40 so that sensor 24 may sense light directed upwardly as indicated in FIG. 4.

Figure 5:
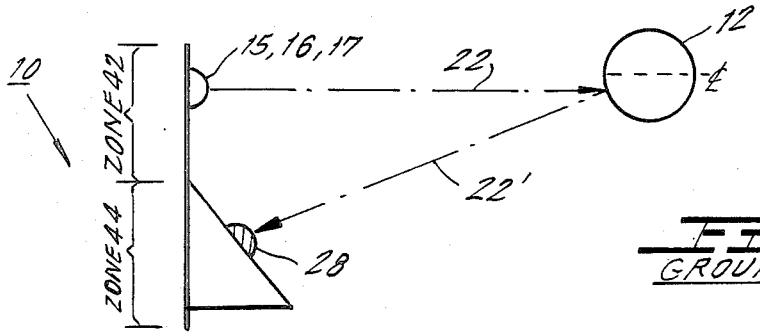

FIG. 5 illustrates a simulated ground ball in that a light beam 22 from one of the light emitters 15, 16 or 17 reflects from a lower portion of the bat 12. Reflected beam 22' is then sensed by light sensor 28 located in ground ball zone 44. The latter is inclined downward and forward from line drive zone 40 so that light sensor 28 may sense reflected light beam 22'.

Figure 6:
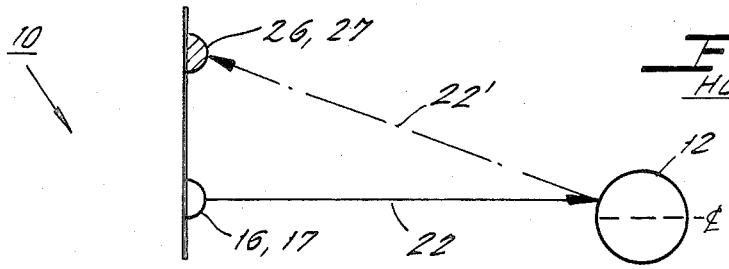

FIG. 6 illustrates a simulated home run in which a light beam 22 emitted from light source 16 or 17 reflects from the upper portion of bat 12. The reflected beam 22' is then sensed by the respective nearest sensor 26 or 27, respectively, above light source 16 or 17.

Figure 7:
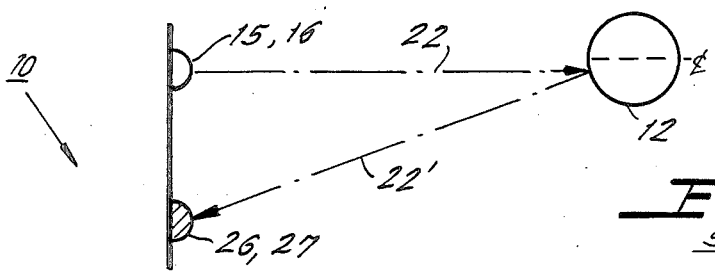

FIG. 7 indicates a simulated "single" wherein light beam 22 emitted from light source 15 or 16 reflects from the lower portion of bat 12. Reflected beam 22' then impinges on the nearest light sensor 26 or 27, respectively, located beneath the light emitter 15 or 16.

The batting results of FIGS. 3–7, although apparently arbitrary, are preferably used with batting practice apparatus 10 as shown in FIG. 1. Other arbitrary batting results may be ascribed to the simulated situations of FIGS. 3–7, however, such as will occur to those skilled in the art.

In apparatus 10, displays 48 are preferably included to provide the batter with immediate visual feedback of what type of simulated "hit" he has made. The displays 48 may indicate, for example, the various simulated hits of FIGS. 3–7.

In FIG. 1 the illustrated "3×3" array of the light emitters 15–17 and light sensors 24–28 in line drive zone 40 is a preferred arrangement. However, arrays of lights and sensors with different arrangements may be provided, such as with greater or fewer light emitters and light sensors. Similarly, greater or fewer light sensors may be provided in the fly ball zone 42 and in the ground ball zone 44, if desired.

To operate light emitters 15–17, light sensors 24–28, and the "feedback" display 48 of apparatus 10, a controller 50 is provided. The controller 50 is conveniently located behind the upright panel 20. With reference to FIG. 8, the controller 50 may comprise a controller **50*a* for controlling light emitters 15–17. A controller 50*b* activates the display 48 of the apparatus 10. Controllers 50*a* and 50*b* may be readily implemented by those of ordinary skill in the art to fulfill the foregoing functions. The choice of which of the lights 15–17 is on at a particular time is a random selection under the control of controller 50*a***.

Controller **50*a* preferably controls both the sequencing of the lights 15–17, and the duration that these lights are on. Sequencing of the lights may be in a random order, or may have an inentional pattern. Thus, in FIG. 9, a light sequencing pattern intentionally representing a "curve" is illustrated by the arrows. Similarly, the light sequencing pattern of FIG. 10** indicated by an arrow simulates a "sinker".

The speed of a pitched ball is simulated by controlling the duration that the lights 15–17 are on. The duration of the light beams provided by light emitters 15–17 is also controlled by the controller **50*a***. The simulation of a fast ball traveling at 90 miles per hour can be realized with a light beam duration of approximately 0.75 to 0.90 seconds. Other speeds may be simulated, as desired.

Controller **50*b* interprets the results to be ascribed to activation of one of light sensors 24–28. The interpretation may be in accordance with the simulated patterns of FIGS. 3–7, or other arbitrary results may be chosen. Controller 50*b* thereupon activates visual displays 48 to provide batter 100** with immediate feedback on the results of his swing.

Additionally, controller **50*b* may be used to interpret results in the curve ball simulation of FIG. 9. Specifically, all the light sensors in FIG. 9 would be "inhibited" when the first light emitter 15 is on, so that activation of any of the light sensors is ignored during this time for purposes of the feedback display 48. The various light sensors would be fully operable and yield feedback information on display 48 when the second and third lights 16 are respectively on. "Striking" of the second light by the bat 12 may indicate the hit of a "hanging curve", and striking of the third light may indicate the hit of a curve ball after it has completed its break. Similarly, in FIG. 10, all the light sensors may be "inhibited" while light 15 is on, but not when the light 16 is on. This would simulate a "sinker" that drops low as it enters batting area 11**.

The apparatus of FIG. 1 preferably includes stationary upright panel 54 on which the panel 20 is mounted in a vertically-slidable fashion so as to permit adjustment for batters of different heights. The rear of panel 20 is supported by brace 60. The bottom of brace 60 is rigidly attached to panel 54, while the top of the brace 60 is slidably attached to panel 20.

The foregoing describes an apparatus that conveniently permits baseball batting practice. Except for a bat, no moving mechanical parts are required. Various types of of pitched balls, such as a curve and sinker, may be simulated by the apparatus. The apparatus provides immediate visual feedback of the results of a "hit" of the simulated pitched ball. For example, a "line drive" or a "fly ball" may be indicated to the batter.

While controller **50*a*** is provided for making random selections of pitches, manually operated pitch selection controls may be provided. The latter may be used when there are two players using the apparatus, with one player controlling pitch selection while the other player is batting.

Although the present invention has been described in connection with a plurality of preferred embodiments thereof, many other variations and modifications will now become apparent to those skilled in the art. It is preferred, therefore, that the present invention be limited not by the specific disclosure herein, but only by the appended claims.

What is claimed is:

1. Baseball batting practice apparatus including:

a plurality of spaced light-emitting devices actuable to simulate a pitched ball by directing respective outgoing beams of light in a first direction to a batting zone;

said batting zone including a front facing said light-emitting devices and a rear opposite said front;

a bat having a light-reflecting portion;

a plurality of pickup means disposed forward of said batting zone to receive reflected light from said light-reflecting portion of said bat while the latter is swung in a generally forward direction through said batting zone by a player and intercepts one of said outgoing beams of light;

said forward direction being opposite said first direction;

said pickup means being divided into a line drive zone, a ground ball zone disposed below said line drive zone and a fly ball zone disposed above said line drive zone;

first means to actuate said light-emitting devices in a plurality of different groups and control the light emitting devices within each of said groups so that they are activated in a predetermined sequential-time relationship to simulate speeds and trajectories for differently thrown balls; and second means to indicate which of said zones contains a pickup means that has received reflected light.

2. Baseball batting practice apparatus as set forth in claim 1 in which said first means operates to randomly select which of said groups of light-emitting devices is actuated.

3. Baseball batting practice apparatus as set forth in claim 1 in which said second means also indicates which section of said line drive zone has been actuated.

4. Baseball batting practice apparatus as set forth in claim 1 in which said outgoing beams of said light-emitting devices are directed from said line drive zone.

5. Baseball batting practice apparatus as set forth in claim 1 in which said ground ball zone is inclined in said first direction and downward from said line drive zone, and said fly ball zone is inclined in said first direction and upward from said line drive zone.

6. Baseball batting practice apparatus as set forth in claim 1 in which said pickup means comprises a plurality of light sensors; each of said light sensors comprising a light detector and a wide angle lens arranged to direct reflected light from a wide angle of incidence onto the light detector, whereby the overall number of light sensors may be minimized.

7. Baseball batting practice apparatus including:

a plurality of spaced light-emitting devices actuable to simulate a pitched ball by directing respective outgoing beams of light in a first direction to a batting zone;

said batting zone including a front facing said light-emitting devices and a rear opposite said front;

a bat having a light-reflecting portion;

a plurality of pickup means disposed forward of said batting zone to receive reflected light from said light-reflecting portion of said bat while the latter is swung in a generally forward direction through said batting zone by a player and intercepts one of said outgoing beams of light;

said forward direction being opposite said first direction;

first means to actuate at least one of said light-emitting devices at a time;

second means to indicate which of said pickup means has received reflected light; and said pickup means comprising a plurality of light sensors; each of said light sensors comprising a light detector and a wide angle lens arranged to direct reflected light from a wide angle of incidence onto the light detector, whereby the overall number of light sensors may be minimized;

said first means also controlling the duration that said light-emitting devices are on so as to simulate speed of a pitched ball.

8. Baseball batting practice apparatus as set forth in claim 7 in which said first means operates to randomly choose which of said light-emitting devices is actuated.

9. Baseball batting practice apparatus as set forth in claim 7 in which said first means operates to actuate a group of said light-emitting devices in a predetermined sequence to simulate a non-straight pitched ball.

10. Baseball batting practice apparatus including:

a plurality of spaced light-emitting devices actuable to simulate a pitched ball by directing respective outgoing beams of light in a first direction to a batting zone;

said batting zone including a front facing said light-emitting devices and a rear opposite said front;

a bat having a light-reflecting portion;

a plurality of pickup means disposed forward of said batting zone to receive reflected light from said light-reflecting portion of said bat while the latter is swung in a generally forward direction through said batting zone by a player and intercepts one of said outgoing beams of light;

said forward direction being opposite said first direction;

said pickup means being divided into a line drive zone, a ground ball zone disposed below said line drive zone and a fly ball zone disposed above said line drive zone;

first means to actuate at least one of said light-emitting devices at a time;

second means to indicate which of said zones contains a pickup means that has received reflected light;

said first means also controlling the duration that said light-emitting devices are on so as to simulate speed of a pitched ball.

11. Baseball batting practice apparatus including:

a plurality of spaced light-emitting devices actuable to simulate a pitched ball by directing respective outgoing beams of light in a first direction to a batting zone;

said batting zone including a front facing said light-emitting devices and a rear opposite said front;

a bat having a light-reflecting portion;

a plurality of pickup means disposed forward of said batting zone to receive reflected light from said light-reflecting portion of said bat while the latter is swung in a generally forward direction through said batting zone by a player and intercepts one of said outgoing beams of light;

said forward direction being opposite said first direction;

said pickup means being divided into a line drive zone, a ground ball zone disposed below said line drive zone and a fly ball zone disposed above said line drive zone;

first means to actuate at least one of said light-emitting devices at a time;

second means to indicate which of said zones contains a pickup means that has received reflected light;

said first means operating to actuate a group of said light-emitting devices in a predetermined sequence to simulate a nonstraight pitched ball.

12. Baseball batting practice apparatus including:

a plurality of spaced light-emitting devices actuable to simulate a pitched ball by directing respective outgoing beams of light in a first direction to a batting zone;

said batting zone including a front facing said light-emitting devices and a rear opposite said front;

a bat having a light-reflecting portion;

a plurality of pickup means disposed forward of said batting zone to receive reflected light from said light-reflecting portion of said bat while the latter is swung in a generally forward direction through said batting zone by a player and intercepts one of said outgoing beams of light;

said forward direction being opposite said first direction;

said pickup means being divided into a line drive zone, a ground ball zone disposed below said line drive zone and a fly ball zone disposed above said line drive zone;

first means to actuate at least one of said light-emitting devices at a time;

second means to indicate which of said zones contains a pickup means that has received reflected light;

said outgoing beams of said light-emitting devices are directed from said line drive zone;

said ground ball zone being inclined in said first direction and downward from said line drive zone, and said fly ball zone is inclined in said first direction and upward from said line drive zone.

13. Baseball batting practice apparatus as set forth in claim 12 in which said first means also controls the duration that said light-emitting devices are on to simulate speed of a pitched ball.

14. Baseball batting practice apparatus as set forth in claim 13 in which said first means operates to randomly choose which of said devices is actuated.

15. Baseball batting practice apparatus as set forth in claim 14 in which said second means also indicates which section of said line drive zone has been actuated.

16. Baseball batting practice apparatus as set forth in claim 13 in which said first means operates to actuate a group of said devices in a predetermined sequence to simulate a non-straight pitched ball.

17. Baseball batting practice apparatus as set forth in claim 16 in which said second means also indicates which section of said line drive zone has been actuated.

18. Baseball batting practice apparatus as set forth in claim 12, in which said pickup means comprises a plurality of light sensors; each of said light sensors comprising a light detector and a wide angle lens arranged to direct reflected light from a wide angle of incidence onto the light detector, whereby the overall number of light sensors may be minimized.

19. Baseball batting practice apparatus including:

a plurality of spaced light-emitting devices actuable to simulate a pitched ball by directing respective outgoing beams of light in a first direction to a batting zone;

said batting zone including a front facing said light-emitting devices and a rear opposite said front;

a bat having a light-reflecting portion;

a plurality of pickup means disposed forward of said batting zone to receive reflected light from said light-reflecting portion of said bat while the latter is swung in a generally forward direction through said batting zone by a player and intercepts one of said outgoing beams of light.

said forward direction being opposite said first direction;

first means to actuate at least one of said light-emitting devices at a time;

second means to indicate which of said pickup means has received reflected light said pickup means comprising a plurality of light sensors; each of said light sensors comprising a light detector and a wide angle of incidence onto the light detector, whereby the overall number of light sensors may be minimized;

said first means to actuate a group of said light-emitting devices in a predetermined sequence to simulate a non-straight pitched ball.

* * * * *